US006789653B1

(12) United States Patent
Hsu et al.

(10) Patent No.: US 6,789,653 B1
(45) Date of Patent: Sep. 14, 2004

(54) CONTACT STRUCTURE FOR CABLE REEL

(75) Inventors: Jung-Hui Hsu, Hsin Chuang (TW); Chia-Cheng Wei, Chung Ho (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 10/628,236

(22) Filed: Jul. 29, 2003

(30) Foreign Application Priority Data

May 16, 2003 (TW) ..... 92209031 U

(51) Int. Cl.[7] ..... H01R 39/00

(52) U.S. Cl. ..... 191/12.2 R; 439/13; 439/18; 439/20; 439/29

(58) Field of Search ..... 191/12.2 R, 12.4, 191/12.2 A; 439/13, 18, 19, 20, 21, 23, 24, 25, 28, 29; 200/51 R, 51.07, 51.14, 51.12

(56) References Cited

U.S. PATENT DOCUMENTS 3,065,380 A * 11/1962 Lauton et al. ..... 361/217
3,193,636 A * 7/1965 Daniels ..... 200/51.12
5,425,645 A * 6/1995 Skovdal et al. ..... 439/23
5,468,912 A * 11/1995 Zalewski ..... 174/86
5,984,687 A * 11/1999 Schwarz ..... 439/17
6,068,490 A * 5/2000 Salzberg ..... 439/25
6,428,325 B1 * 8/2002 Kurosawa et al. ..... 439/21
6,576,852 B1 * 6/2003 Shu ..... 200/51 R

* cited by examiner

*Primary Examiner*—Mark T. Le
(74) *Attorney, Agent, or Firm*—Troxell Law Office PLLC

(57) ABSTRACT

A contact structure includes a fixed contact set, said fixed contact set having a stepped cap and a plurality of contact rings of different diameters respectively mounted in annular steps of the stepped cap and respectively connected to the conductors of a fixed cable, and a movable contact set, the movable contact set having a stepped shaft rotatably inserted into the stepped cap, spring members mounted in peripheral holes in the steps of the stepped shaft, and arched contact plates respectively connected to the conductors of a movable cable and respectively supported on the spring members and forced by the spring members into contact with the contact rings of the fixed contact set.

11 Claims, 4 Drawing Sheets

CONTACT STRUCTURE FOR CABLE REEL

BACKGROUND OF THE INVENTION

1. Field of the Invention

The present invention relates to a cable reel and, more specifically, to a contact structure for cable reel, which keeps the contact plates in positive contact with the contact rings when the movable cable, which is connected to the contact plates, is turned relative to the fixed cable, which is connected to the contact ring.

2. Description of the Related Art

A cable reel, for example, a power cord reel is used to hold a power cord, enabling the power cord to be extended to a remote place. When a power cord reel is used, the electric plug of the power cord of the power cord reel is connected to power source, and then the power cord is extended out of the bobbin of the power cord reel, for enabling the power cord reel to be moved to the desired remote plate for the connection of an electric apparatus. The power cord reel has at least one electric socket for output of power supply. The at least one electric socket is located on the bobbin. When extending out the power cord, the at least one electric socket is rotated with the bobbin, preventing twisting of the conductors of the power cord. When using the power cord reel in this manner during raining, the at least one electric socket may be wetted, resulting in an electric leakage. In order to eliminate this problem, one electric socket of the power cord reel is connected to power supply by an electric cable, and then the power cord is extended out of the bobbin of the power cord reel and connected to an electric device at a remote place. When rotating the bobbin to extend out the power cord, the electric cable may be twisted and tangled. The power cord reel of a vacuum cleaner has the same problem.

SUMMARY OF THE INVENTION

The present invention has been accomplished under the circumstances in view. According to one aspect of the present invention, the contact structure comprises a fixed contact set, and a movable contact set. The fixed contact set comprises a stepped cap, the stepped cap having a plurality of annular steps of different diameters, and a plurality of contact rings of different diameters respectively mounted in the annular steps and respectively connected to the conductors of a fixed cable. The movable contact set comprises a stepped shaft rotatably inserted into the stepped cap of the fixed contact set, the stepped shaft having a plurality of steps corresponding to the annular steps of the stepped cap of the fixed contact set and a plurality of peripheral holes respectively formed in the steps, spring means mounted in the peripheral holes in the steps of the stepped shaft, and a plurality of arched contact plates respectively supported on the spring means in the peripheral holes and forced by the spring members into contact with the contact rings of the fixed contact set.

According to another aspect of the present invention, the stepped shaft comprises pairs of stop flanges respectively suspended in the peripheral holes in the steps thereof; the contact plates of the movable contact set each have two curved locating wings symmetrically disposed at two sides and respectively stopped against the stop flanges in the peripheral holes of the steps of the stepped shaft.

According to still another aspect of the present invention, the contact plates each have an inwardly curved guide flange disposed at a top side for guiding the movable contact set into movable connection with the fixed contact set.

DETAILED DESCRIPTION OF THE PREFERRED EMBODIMENT

Figure 1A:
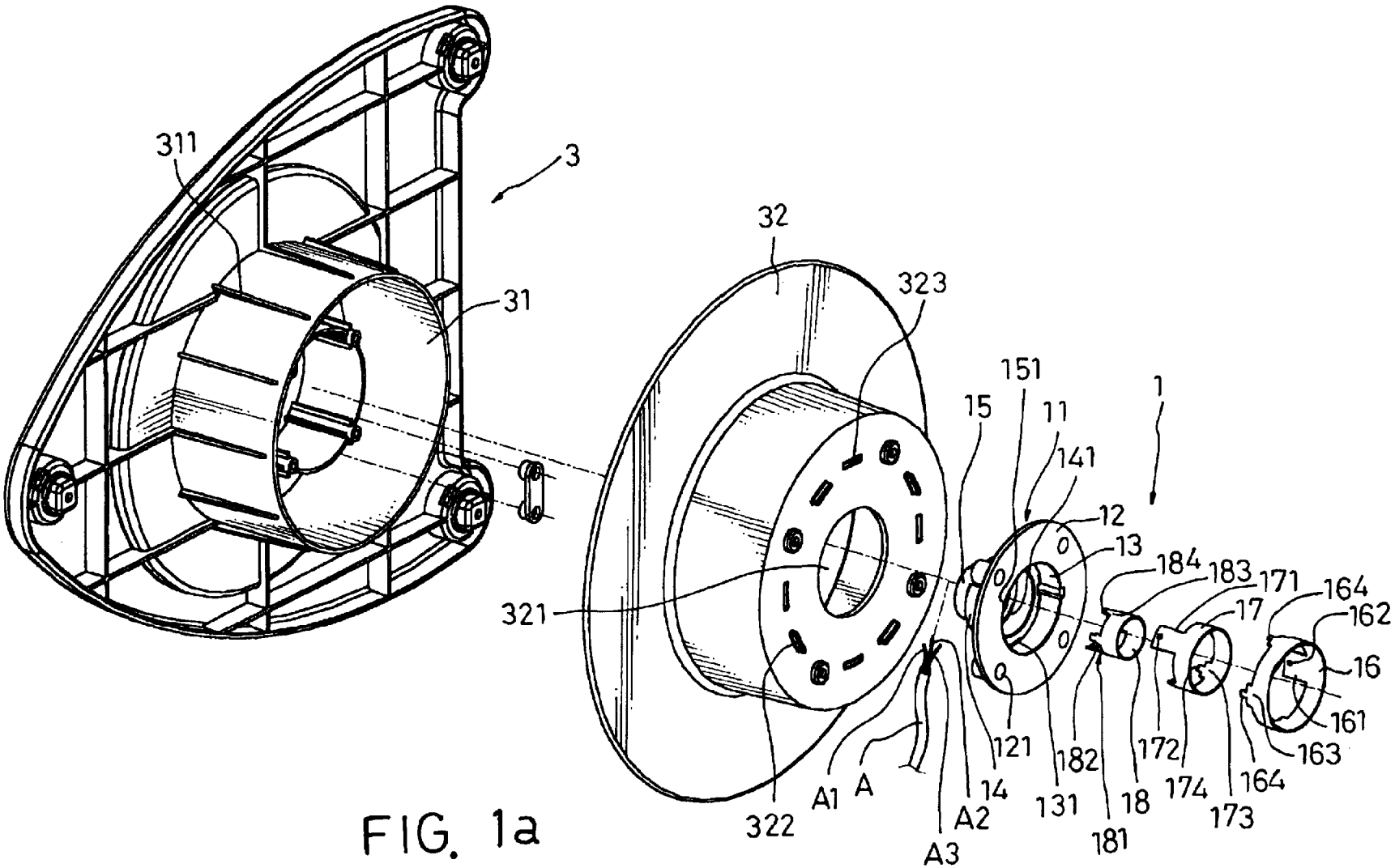
FIG. 1*a* is an exploded view of the contact structure according to the present invention (Part I).
Figure 1B:
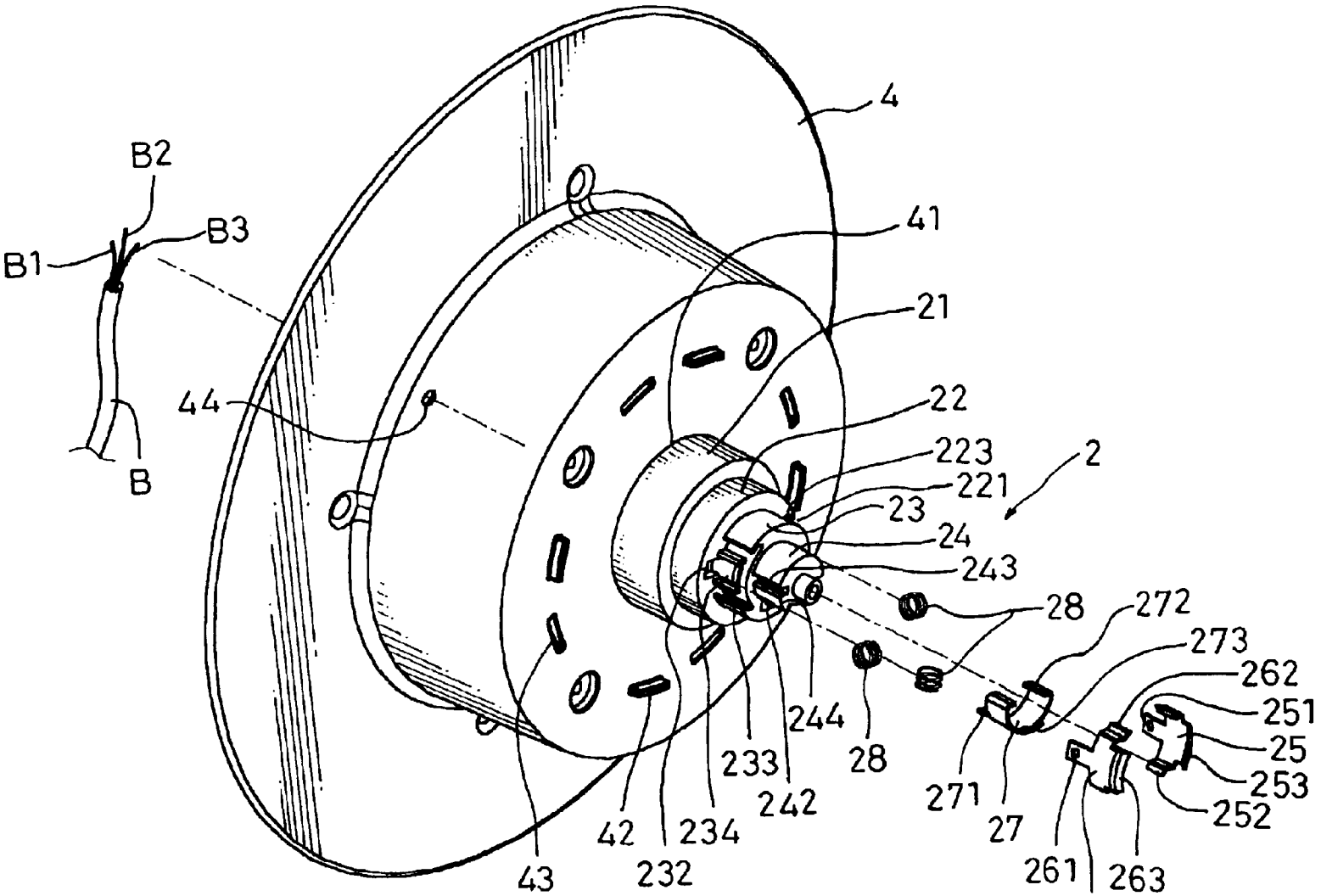
FIG. 1*b* is an exploded view of the contact structure according to the present invention (Part II).
Figure 2:
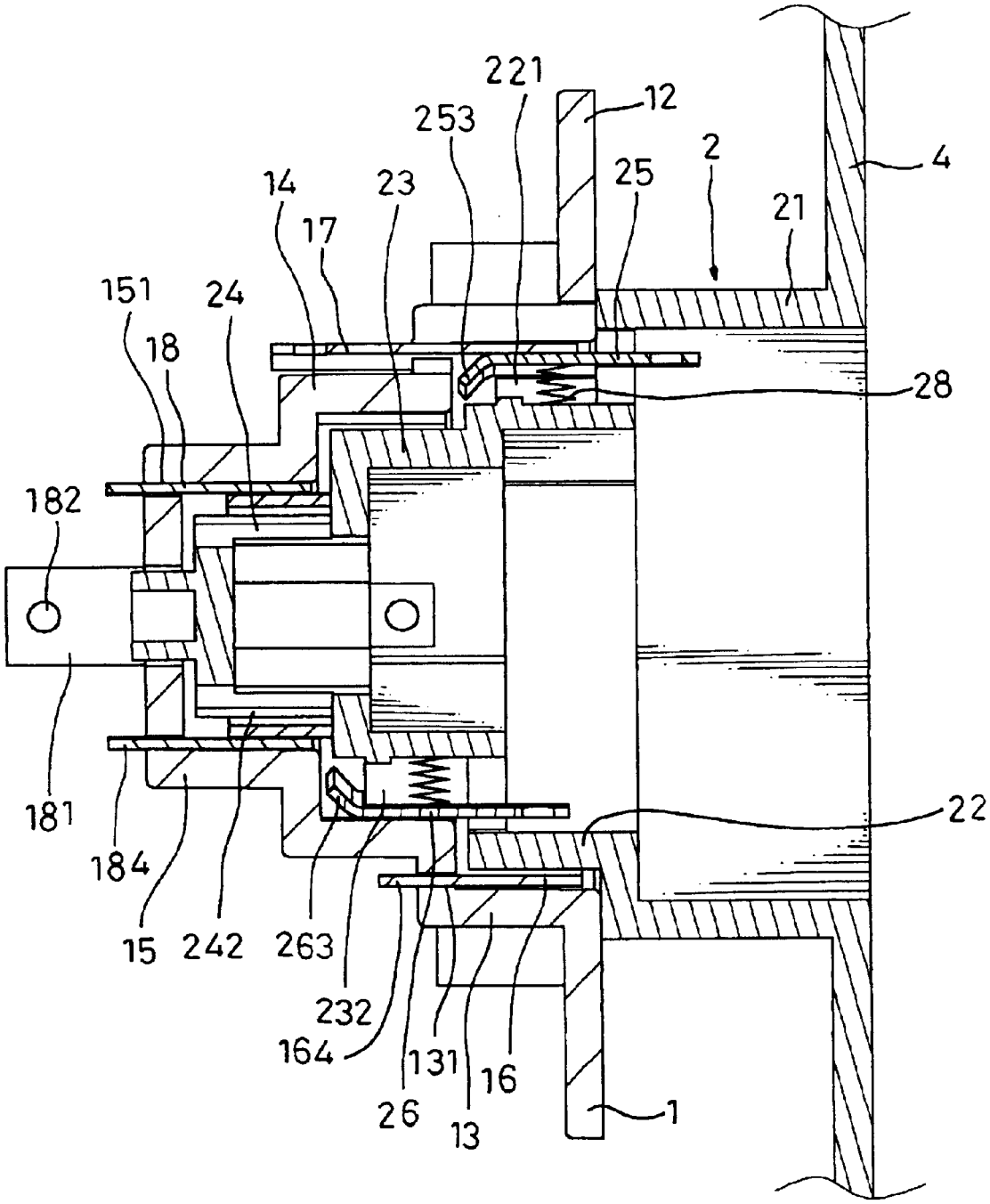
FIG. 2 is a sectional assembly view of the present invention.
Figure 3:
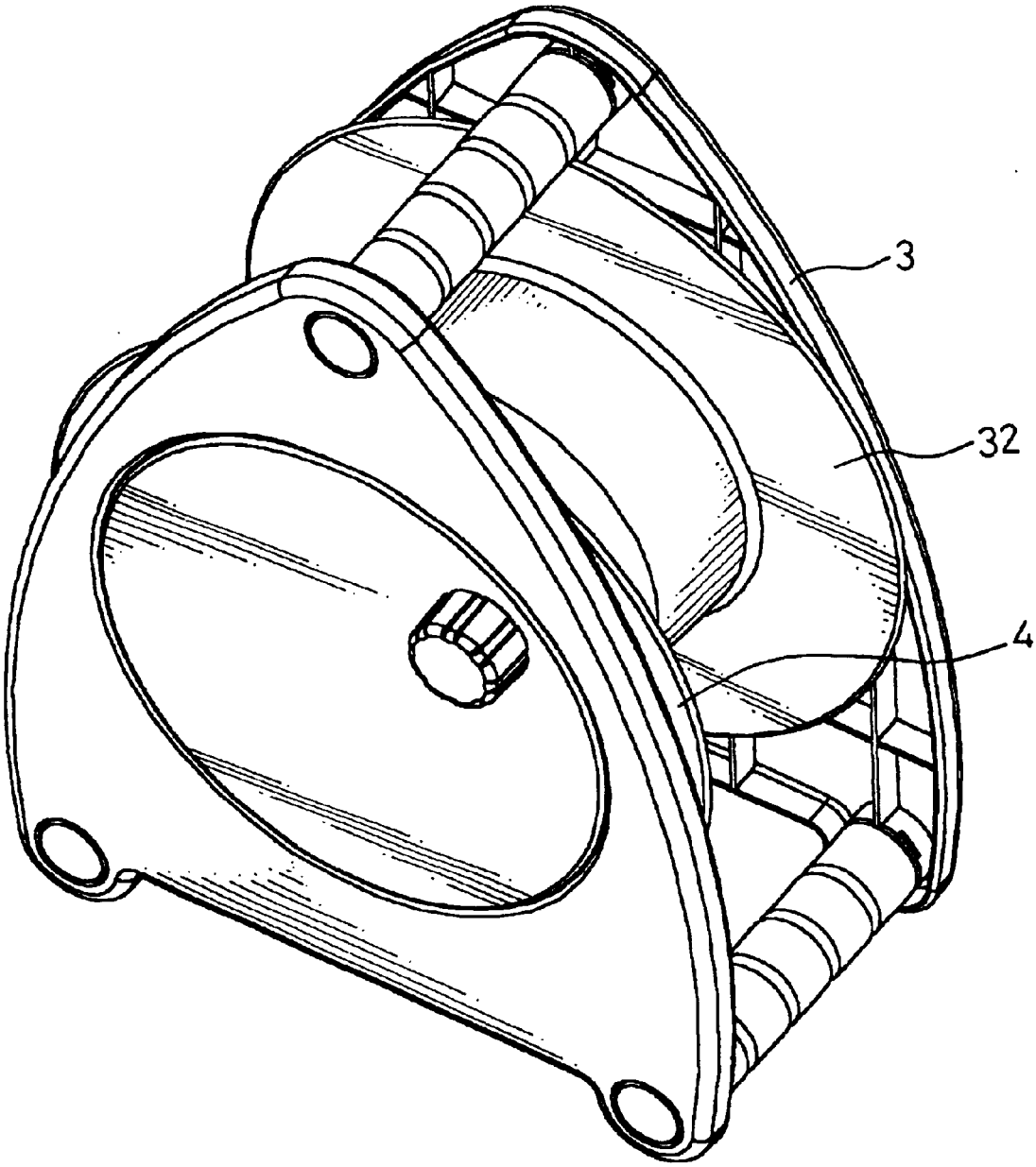
FIG. 3 is an elevational assembly view of the present invention.

Referring to FIGS. 1~3, a contact structure for cable reel is shown comprised of a fixed contact set 1, and a movable contact set 2.

The fixed contact set 1 comprises a stepped cap 11, and a plurality of contact rings of different diameters, namely, the first contact ring 16, the second contact ring 17, and the third contact ring 18. According to the present preferred embodiment, the stepped cap 11 is a hollow, cylindrical, three-step cap to fit the hot wire, neutral wire, and grounding wire of a power cord. The stepped cap 11 comprises a face panel 12, and a series of annular steps of different diameters, namely, the first annular step 13, the second annular step 14, and the third annular step 15 for accommodating the first contact ring 16, the second contact ring 17, and the third contact ring 18 respectively. For the connection of a fixed cord member, for example, a power cord A to the contact rings 16~18, the contact rings 16~18 have a respective connecting lug 161, 171, or 181 respectively inserted through a respective through hole 131, 141, or 151 in the annular steps 13~15 and connected to the conductors A1~A3 of the fixed power cord A respectively.

The connecting lugs 161, 171, and 181 have a respective mounting hole 162, 172, or 182 to which the conductors A1~A3 of the fixed power cord A are fastened respectively. The contact rings 16~18 each further have a mounting strip 163, 173, or 183 terminating in a respective retaining portion 164, 174, or 184. The mounting strips 163~183 are respectively inserted through the through holes 131, 141, and 151 of the annular steps 13~15, and then the retaining portions 174~184 are bent backwards to secure the contact rings 16~18 to he annular steps 13~15 respectively.

The face panel 12 of the stepped cap 11 of the fixed contact set 1 has a plurality of mounting through holes 121 fastened to a holder 3. The holder 3 comprises a barrel 31, which has a plurality of transversely extended sloping ribs 311 around the periphery, and a wheel 32 rotatably supported on the barrel 31.

The movable contact set 2 comprises a stepped shaft 21 insertable into the stepped cap 11 of the fixed contact set 1, and a plurality of arched contact plates, namely, the first contact plate 25, the second contact plate 26, and the third contact plate 27. The stepped shaft 21 comprises a series of annular steps of different diameters, namely, the first step 22, the second step 23, and the third step 24 for accommodating the first contact plate 25, the second contact plate 26, and the third contact plate 27 respectively. The steps 22~24 each have a respective peripheral hole 221, 231, or 241 for the positioning of the contact plates 25~27, and a respective bottom hole 222, 232, or 242 through which the respective connecting lugs 251, 261, and 271 of the contact plates 25~27 are inserted and connected to the conductors B1~B3 of a movable cord member, for example, a movable power cord B.

In order to prevent disconnection of the contact plates 25~27 from the peripheral holes 221~241 of the steps 22~24 of the stepped shaft 21, the contact plates 25~27 are made having two curved locating wings 252, 262, or 272 symmetrically disposed at two sides and respectively stopped against respective stop flanges 223, 233, or 243 in the peripheral holes 221~241 of the steps 22~24 of the stepped shaft 21. Spring means, for example, compression springs 28 are respectively mounted on a respective pin 224, 234, or 244 in the peripheral holes 221~241 of the steps 22~24 of the stepped shaft 21 to support the contact plates 25~27, holding the contact plates 25~27 in positive contact with the contact rings 16~18 (see FIGS. 2 and 3). Further, the contact plates 25~27 each have an inwardly curved guide flange 253, 263, or 273 disposed at the top side for guiding the movable contact set 2 into movable connection with the fixed contact set 1 for electric signal transmission.

The movable contact set 2 and the fixed contact set 1 are connected to or installed in a wheel 4. The wheels 32 and 4 each have a center through hole 321 or 41, a plurality of locating blocks 322 or 42 and recessed locating holes 323 or 43 alternatively arranged around the center through hole 321 or 41. The wheels 32 and 4 are abutted against each other by engaging the locating blocks 322 or 42 of one wheel 32 or 4 into the recessed locating holes 43 or 323 of the other wheel 4 or 32. Screws may be used to fixedly secure the wheels 32 and 4 together. When connected, the wheels 32 and 4 form a bobbin. The movable power cord B is inserted through a wire hole 44 in the wheel 4, and then wound round the shaft of the bobbin of the wheels 4 and 32.

According to the present invention, relative rotary motion between the fixed power cord and the movable power cord does not cause the power cords to tangle, and the contact plates of the movable contact set are constantly maintained in close contact with the respective contact rings of the fixed contact set, assuring stability of electric signal transmission. Therefore, the invention is practical for use in a power cord trolley, a power cord reel in a vacuum cleaner, or a signal line in an electric apparatus.

A prototype of contact structure for cable reel has been constructed with the features of FIGS. 1~3. The contact structure for cable reel functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A contact structure comprising:

a fixed contact set, said fixed contact set comprising a stepped cap, said stepped cap having a plurality of annular steps of different diameters, and a plurality of contact rings of different diameters respectively mounted in said annular steps and respectively connected to the conductors of a fixed cable; and a movable contact set, said movable contact set comprising a stepped shaft rotatably inserted into the stepped cap of said fixed contact set, said stepped shaft having a plurality of steps corresponding to the annular steps of said stepped cap of said fixed contact set and a plurality of peripheral holes respectively formed in the steps, spring means mounted in the peripheral holes in the steps of said stepped shaft, and a plurality of arched contact plates respectively supported on said spring means in said peripheral holes and forced by said spring means into contact with the contact rings of said fixed contact set.

2. The contact structure as claimed in claim 1, wherein said stepped shaft comprises pairs of stop flanges respectively suspended In the peripheral holes in the steps thereof; said contact plates of said movable contact set each have two curved locating wings symmetrically disposed at two sides and respectively stopped against the stop flanges in the peripheral holes of the steps of said stepped shaft.

3. The contact structure as claimed in claim 2, wherein said spring means is comprised of a plurality of compression springs respectively mounted on a respective pin in the peripheral holes of the steps of said stepped shaft.

4. The contact structure as claimed in claim 1, wherein said contact plates each have an inwardly curved guide flange disposed at a top side for guiding said movable contact set into movable connection with said fixed contact set.

5. The contact structure as claimed in claim 1, wherein said contact rings each have a respective connecting lug respectively inserted through a respective through hole in the annular steps of said stepped cap and respectively connected to the conductors of a fixed cable.

6. The contact structure as claimed in claim 1, wherein said stepped cap has a plurality of through holes respectively formed in the annular steps thereof; said contact rings each further have a mounting strip respectively inserted through the through holes in the annular steps of said stepped cap, and a retaining portion extended from the respective mounting strip and hooked on the through holes in the annular steps of said stepped cap.

7. The contact structure as claimed in claim 1, wherein said stepped shaft have a plurality of bottom holes in the steps thereof; said contact plates each have a connecting lug respectively inserted through the bottom holes of said stepped shaft and respectively connected to the conductors of a movable cable.

8. The contact structure as claimed in claim 5, wherein the connecting lugs of said contact rings have a mounting hole for the connection of the conductors of said fixed cable.

9. The contact structure as claimed in claim 7, wherein the connecting lugs of said contact plates each have a mounting hole for the connection of the conductors of said movable cable.

10. The contact structure as claimed in claim 1, wherein said fixed contact set is mounted in a holder, said holder comprising a barrel and a first wheel member rotatably supported on said barrel; said movable contact set is mounted in a second wheel member fastened to said first wheel member of said holder, said first wheel member and said second wheel member forming a bobbin for the winding of said movable cable.

11. The contact structure as claimed in claim 10, wherein said first wheel member has a plurality of mounting holes and locating blocks alternatively arranged around a center through hole thereof; said second wheel member has a plurality of mounting blocks and mounting holes alternatively arranged around a center through hole thereof and respectively fastened to the mounting holes and mounting blocks of first wheel member.

* * * * *